US008757037B2

(12) United States Patent
Cavlin

(10) Patent No.: US 8,757,037 B2
(45) Date of Patent: Jun. 24, 2014

(54) PUNCH FORM AND METHOD OF DIE-CUTTING WITH IT

(75) Inventor: Soren Cavlin, Taby (SE)

(73) Assignee: SOBI HB, Taby (SE)

( * ) Notice: Subject to any disclaimer, the term of this patent is extended or adjusted under 35 U.S.C. 154(b) by 0 days.

(21) Appl. No.: 12/793,541

(22) Filed: Jun. 3, 2010

(65) Prior Publication Data

US 2010/0300255 A1 Dec. 2, 2010

Related U.S. Application Data

(62) Division of application No. 10/499,089, filed as application No. PCT/SE02/01466 on Aug. 16, 2002.

(30) Foreign Application Priority Data

Dec. 20, 2001 (SE) ..... 0104345

(51) Int. Cl.
*B26D 7/18* (2006.01)

(52) U.S. Cl.
USPC ..... 83/13; 83/128; 83/138; 83/169; 83/346

(58) Field of Classification Search
USPC ..... 83/125, 128, 138, 346, 613, 658, 659, 83/13, 169

IPC ..... B26D 7/1818; B21D 45/03
See application file for complete search history.

(56) References Cited

U.S. PATENT DOCUMENTS

| | | | | | |
|---|---|---|---|---|---|
| 3,137,188 | A | * | 6/1964 | Domka | 83/124 |
| 3,280,681 | A | * | 10/1966 | Turner | 83/169 |
| 3,850,064 | A | | 11/1974 | Dwyer | |
| 4,164,881 | A | * | 8/1979 | Jenkins | 83/128 |
| 4,522,095 | A | * | 6/1985 | Saunders et al. | 83/116 |
| 5,129,295 | A | * | 7/1992 | Geffros et al. | 83/19 |
| 5,179,882 | A | | 1/1993 | Takeuchi et al. | |
| 5,622,587 | A | | 4/1997 | Barthelman | |

FOREIGN PATENT DOCUMENTS

| | | |
|---|---|---|
| WO | 90/08018 | 7/1990 |
| WO | 00/71333 | 11/2000 |

* cited by examiner

*Primary Examiner* — Kenneth E. Peterson
(74) *Attorney, Agent, or Firm* — Dowell & Dowell, P.C.

(57) ABSTRACT

A method of feeding packaging material (5, 11) between a punch form (1) and an anvil (12) and bringing the punch form (1) and the anvil (12) together so that the packaging material (5, 11) is die-cut in such a manner that a relative sliding (9) occurs between the packaging material (5, 11) and the actual sheet material (4) of the election rubber (3) during the die-cutting course, even when the clamping pressure (8) is applied.

9 Claims, 4 Drawing Sheets

PUNCH FORM AND METHOD OF DIE-CUTTING WITH IT

CROSS REFERENCE TO RELATED APPLICATIONS

This application is a divisional application of Ser. No. 10/499,089, filed Jun. 16, 2004, in the name of the same inventor, and which is a National Phase application of PCT/SE02/01466, filed Aug. 18, 2002.

BACKGROUND OF THE INVENTION

1. Field of the Invention

The present invention concerns a punch form, comprising cutting knives and/or scoring rules, whereby the punch form at least partly is dressed with sheet material which is provided in the punch form so that a crack reducing effect on the packaging material is achieved at least in association with the cutting knives and/or scoring rules, and a method for die-cutting packaging material by means of a punch form, comprising cutting knives and/or scoring rules and sheet material which is arranged in the punch form so that a crack reducing effect in the packaging material is achieved at least in association with the cutting knives and/or scoring rules, wherein the packaging material is brought in between said punch form and an anvil, whereby the punch form and the anvil are brought together so that the packaging material will be die-cut. The expression "packaging material" shall here be considered to have a broad meaning and comprise, for example, display material.

2. Description of Related Art

Die-cutting of packaging material may be executed in different ways. Thus, a punch form may be stationary or movable. In the first case the packaging material is fed in between the punch form and an anvil and in the second case the packaging material is fed together with the punch form. In the punching nip, i.e. where the punching takes place, the packaging material is clamped between the cutting knives and/or scoring rules of the punch form and an anvil, and die-cutting occur rapidly.

Cutting means, i.e. cutting knives, scoring rules etc, are generally mounted to a flat or cylindrical bed, a so called flat punch form and rotational punch form, respectively. For each package to be produced a specially designed punch form is required, which is mounted in the present die-cutting apparatus at the time for production.

The punch anvils may have the form of a flat plate or a rotating cylinder.

In the punch nip the cutting knives cut fully through the packaging material while the scoring rules and other means only partly cut through or only deform the packaging material. Generally, score or fold lines are attained, which reduce the bending rigidity in the packaging material.

During die-cutting, cracks easily arise in the die-cut packaging material, especially in the vicinity of the cutting knives and the scoring rules, due to the severe stress in the packaging material.

The die-cut packaging material is pushed out of the punch form by means of resilient elements generally so called rubber ejectors. Such rubber ejectors are generally in direct contact with the packaging material.

After the ejection from the punch form, the die-cut packaging material is passed on and overflow material, so called die-cutting spill, is removed from the packaging blanks, either in connection with the ejection of the packaging blanks from the punch form and leaves the punching nip in question or at a special operation directly afterwards.

When feeding of packaging material to and from the punching nip, during when the punch pressure is activated or deactivated, at ejection and connected removal of spill occur, the packaging material sometimes is deformed in an unwanted way, for example, being bent and/or sheared. As a result a certain percentage of the produced packaging blanks will be damaged, incompletely cleaned from spill or obtain erroneous dimensions. The problems increase with increasing production speed and the level of problem varies for packaging material with different rigidity, moisture levels, etc.

Another problem is damages in the surface of the packaging material caused by the at certain points positioned rubber ejectors, especially at die-cutting of pressure sensitive packaging material and at high production speeds.

These problems may be alleviated by providing a sheet material between the punch form and the packaging material, as described in EP 454753 B1, the content of this is hereby incorporated into this description. The sheet material in question may be dressed on portions of or over the whole punch form, depending on technical requirements and economical considerations.

Also with this solution problems may arise with damaged and incompletely spill cleaned packaging blanks. These problems increase with increasing production speed and increased punching pressure.

SUMMARY OF THE INVENTION

The object of the present invention is to, in a simple and inexpensive way, improve the known die-cutting technology in order to minimize unwanted incorrectnesses in the die-cut packaging blanks and at the same time allow increased production speed.

In accordance with the invention, this is achieved by means of a method and a punch form, according to the preamble, which have the features of the enclosed claims.

The basic technology as shown in EP 454753 B1 assures that the packaging material during the die-cutting remains flat against the anvil and cannot move out of the plane, for example denting, anywhere during the period of time the punching pressure is activated or deactivated. This technology alleviates the main part of the problems when die-cutting.

In the industry it is also of interest to refine the technology, i.e. take away all the problems.

In this context it is possible to eliminate troublesome air, which disturb the flattening out, which may be done with efficient evacuating, see WO 00/71333 of the same applicant.

Still a few problems remain, the reliability is not satisfying, especially when it comes high punching speeds when high ejecting pressure must be used, which is, from an industrial point of view, very important to solve. This concerns the crack reduction as well as the integrated moment of pushing out/cleaning of the die-cutting spill from the punch form during the die-cutting course. These problems may in a large proportion be derived from occurring uneven loadings close to the cutting knives and the scoring rules, which arise in connection with activation and ejection of the packaging material, partly due to edge effects from the sheet material and partly due to irregularities in mechanical properties and surface of the packaging material.

The most obvious technology method to solve the last mentioned problem is naturally to increase the pressure of the sheet material against the packaging material to make sure that the packaging material is kept in the right position during the die-cutting and to fully guide its movements during activation as well as deactivation of the punching pressure besides providing the sheet material with smooth edges that will not incise and thus reduce the problems.

The present invention implies on the contrary that a relative sliding movement between the sheet material and the packaging material is not to be prevented but rather shall be facilitated by selecting sheet material with low surface friction and adhesion to the packaging material, at the same time as the packaging material with high pressure shall be prevented from denting out of the sheet material. The friction and adhesion between the sheet material and the packaging material shall be so low that a relative sliding movement can take place between the sheet material and the packaging material.

Due to this fact the packaging material will be able to flow, "surf", against the different portions of the punch form, without the risk of lockings and disturbing friction and adhesion forces on the sheet material despite the fact that very high punching pressures are applied.

When using known technology the sheet material clamps the surface of the packaging material and prevents sliding movements at die-cutting. The punch energy from the cutting knives or the scoring rules will thus be concentrated to the clamping length between the edge of the sheet material and the cutting means in question.

If instead a certain sliding can take place in the "clamp," i.e. in the contact surface between the sheet material and the packaging material, as mentioned above, partly a certain adjustment of the packaging material can occur by said sliding during both activation and deactivation, partly the elongation and the punch energy in the surface of the packaging material will be distributed over a greater length and surface, respectively, which decrease the risk for crack formation. Thus, contrary to conventional beliefs, the packaging material shall not be fixedly held against the sheet material.

The load energy which is applied by the cutting knives/scoring rules will thus be possible to distribute over a greater area and therefore will not reach crack propagating levels. Local irregularities in friction and adhesion in the contact surface between the packaging material and the sheet material become insignificant and the load tends to distribute itself in a way that decrease rather than increase the tension concentration.

With this the opportunity will open up for increasing the pressure against the plane, increasing the speed of ejection and cleaning and thus makes it possible to increase production without increasing the error rate at the same time.

Depending on the high contact pressure on the sheet material and the moisture level, surface properties etc. of the packaging material, a certain adhesion/adherence between the sheet material and the compressed packaging material occurs. Such adhesion or friction do not only prevent the above mentioned sliding movements in connection with activation of the punching pressure but also disturb the separation of the die-cut packaging material from the punch form during deactivation of the punching pressure and the ejection or the combined ejection and/or cleaning phase in rotational die-cutting. This is especially pronounced at high punching speeds, i.e. ejection speeds, which results in a larger proportion incompletely cleaned packaging blanks. Most expressed and most valuable is the invention at rotational die-cutting, where the die-cutting spill is removed by the rotating anvil cylinder during high pressure in a combined phase with the ejection and at the same time as the die-cutting spill pass out from the punching nip.

An effective way to solve this problem is to use a sheet material whose contact surface, at least at selected areas, has low adhesion. For example it could be a hydrophobic material, i.e. such material that rather repel than adhere moist and thus with ease also repels the moist packaging material.

The invention is based on the insight that a surprising and pronounced improvement of the basic technology is achieved when the friction and adhesion are reduced between the sheet material and the packaging material. Thereby an opportunity is given for the packaging material, despite the fact that the sheet material clamps with high pressure against its surface, to have the time to adjust itself, slide, flow out, stretch out in the clamping zone of the sheet material before the cutting knives/scoring rules with full power incised and loaded at maximum the packaging material. The lower friction and adhesion between the sheet material and the packaging material also gives a pronounced advantage when the die-cutting spill shall be cleaned off in connection with the ejection of the packaging blanks.

As a result of the above mentioned effects the pressure orthogonally to the surface of the packaging material may be pronouncely increased, which is a necessity for increased ejection speed, which may be accomplished by, for example, using harder rubber ejectors, which in turn makes it possible to increase production speed with maintained or decreased error rate of produced packaging blanks. Further, as a result of the invention, the error rate depending on variations in the surface of the packaging material decreases and high production speed may be applied independent of the packaging material to be die-cut.

It has shown that the die-cutting process works well even at extremely high speeds, although increased punching speed increases the requirement of the tribology properties of the surface of the sheet material regarding the packaging material in question.

The sheet material may be of a material with low surface friction, such as TEFLON® (polytetrafluoroethylene or PTFE), or at least partly provided with a surface with low surface friction, where the surface friction does not exceed 0.39, preferably does not exceed 0.33 and most preferred does not exceed 0.27, typically 0.33, measured according to ISO 8295. At higher production speeds the normal requirement of said friction increases. Low friction may, for example, be provided by processing of the surface so that a smooth surface is obtained or by coating with a surface material with low friction.

In order to amplify the above mentioned effect, the surface of the sheet material, which comes into contact with the packaging material during the die-cutting, may when the sheet material is manufactured be made smooth and/or be supplied with friction reducing agent, and in addition at need during the die-cutting process continuously or intermittent be supplied with friction reducing agent by means of spraying, coating or the like. The added friction reducing agent may for example be formulated starting from a silicon oil, TEFLON® (polytetrafluoroethylene or PTFE), etc.

The person skilled in the art realizes that the method may be selectively applied on the different sections of the sheet material, i.e. delimited to the sections where problems arise.

The sheet material may be of a material with low adhesion or at least partly provided with a surface with low adhesion, where the adhesion defined as surface tension energy does not exceed 0.050 N/m, preferably does not exceed 0.043 N/m and most preferred does not exceed 0.036 N/m, evaluated with the contact angle method according to ASTM D-5725. At higher production speeds the normal requirement on said adhesion increases.

The sheet material may cover the whole surface of the punch form but may, giving an economical advantage, be concentrated to delimited sections of the punch form to eliminate certain problems in the production or for the client in question.

This secures that the production may be done in an increased speed, that the ejection and connected cleaning of the packaging material may be performed with increased load and thus increased speed, without, at the same time, increasing the frequency of damaged or incompletely cleaned packaging blanks. Separate spill cleaning operations is not intended but only such spill cleaning that is made in direct connection to and integrated with the ejection of the die-cut packaging blank from the punch form.

BRIEF DESCRIPTION OF THE DRAWINGS

The invention will now be described in an exemplifying way and referring to attached drawing, in which.

DETAILED DESCRIPTION OF THE PREFERRED EMBODIMENTS OF THE INVENTION

Figure 1:
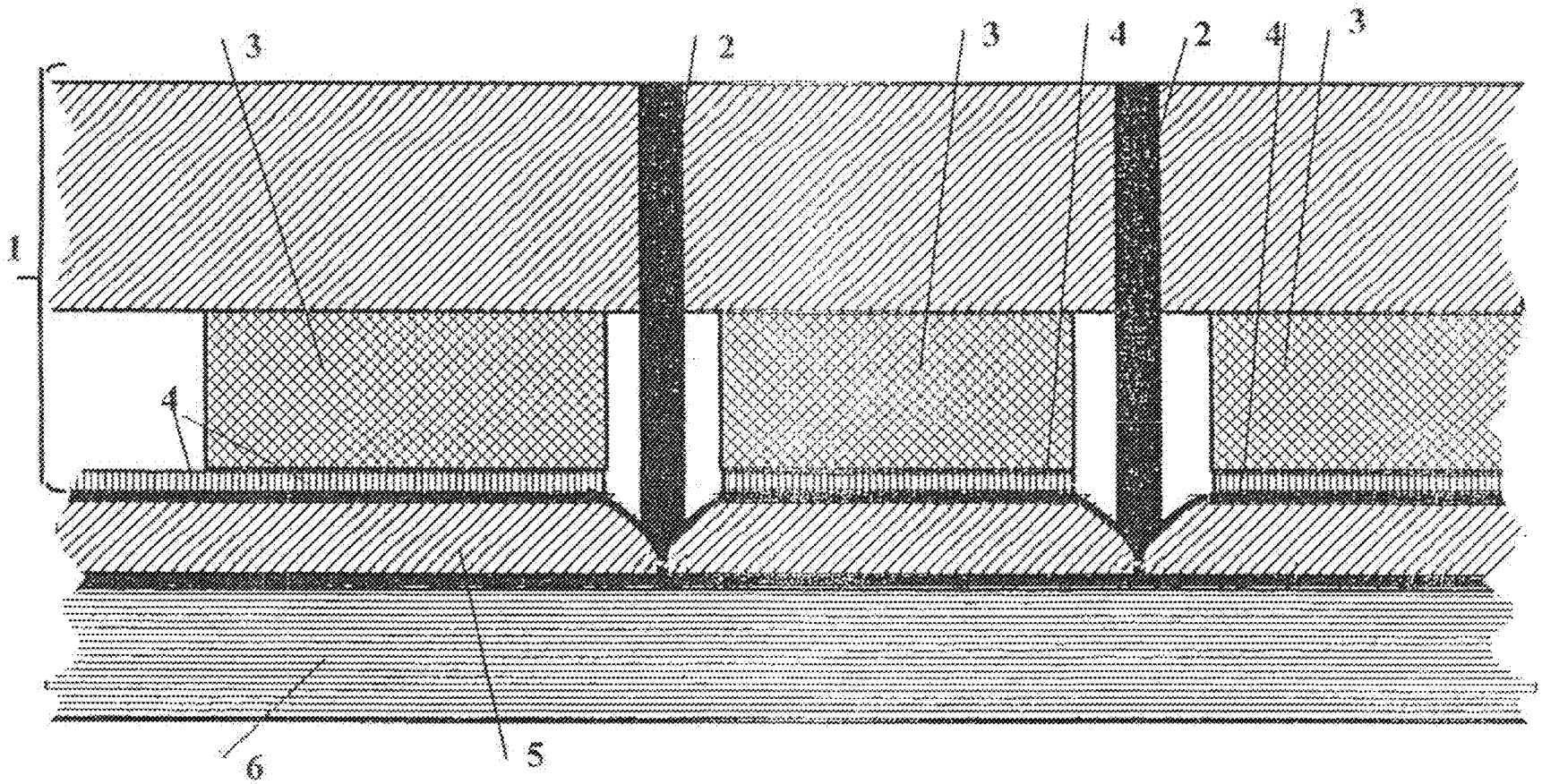
FIG. 1 illustrates a punch form according to the present invention in the stage where a cutting knife starts to cut through a packaging material to be die-cut.

In FIG. 1 a portion of a punch form 1 is illustrated, provided with cutting means, in the shown case two parallel cutting knives 2, rubber ejectors 3 and a sheet material 4, in the die-cutting stage when the cutting knives 2 penetrate through a packaging material 5 which is clamped between the sheet material 4 and an anvil 6.

The pressure from the punch form 1 via the rubber ejectors 3 and the sheet material 4 shall be high against the packaging material 5 to be die-cut against the punching anvil 6. Despite said high clamping pressure from the sheet material, the top surface of the packaging material 5 can nevertheless slide somewhat relative the sheet material 4 due to the fact that the sheet material 4 has a low surface friction and/or low adhesion.

During the period of time the cutting knives 2 penetrate into the packaging material 5 no gliding can occur just in these positions but on the contrary gliding of the packaging material 5 may still occur under a scoring rule, during the period of time when the punching pressure is activated. Not until the cutting knife has fully cut through the packaging material it may slide again from the knife position in question.

If it is a short clamping length between two cutting means in a previously known punch form, i.e. a punch form which does not show a sheet material with low surface friction and adhesion, the tensile strength limit could easily be reached at the surface of the packaging material due to the tensile stress concentration. However, with the punch form of the present invention the clamping length increases and may be as long as the distance between two neighbouring cutting knives 2 since certain sliding of the packaging material 5 can occur at the scoring rules.

After full through cut, sliding may again occur at respective knife if the friction and the adhesion of the sheet material are low in relation to current pressure and tensile stress. That means that the tensile stress in the surface of the packaging material 5 may be spread over a greater length during the cutting through as well as immediately afterwards and thus the stresses in the surface do not risk to reach the tensile strength limit or crack propagation levels.

The same may be said about the clamping between the rubber ejector 3 and adjacent cutting knife. If the rubber ejector 3 is not dressed with a sheet material with a surface having a low friction and/or adhesion a fixed clamping between the rubber ejector 3 and the cutting knife 2 arise and this clamping length 13 is usually very short, see FIG. 2. If instead the rubber ejector 3 is dressed with a sheet material 4 having low surface friction and/or low adhesion a sliding of the packaging material 5 can occur relative the rubber ejector 3 and the clamping length 13 becomes the length to the next cutting knife 2, see FIG. 3.

Figure 2:
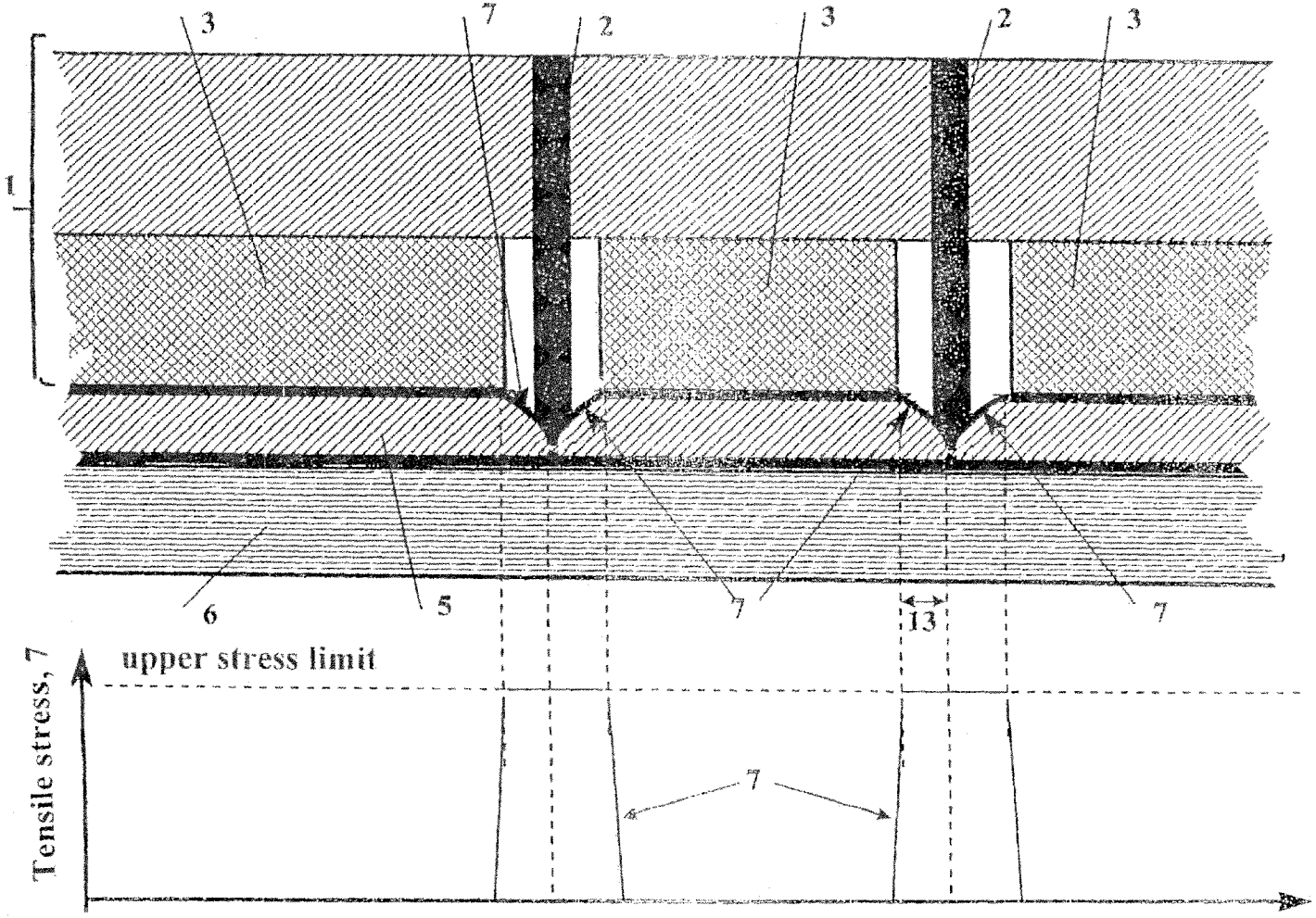
FIG. 2 illustrates the tensile stress concentration at the top surface of the packaging material at die-cutting according to known technology.
Figure 3:
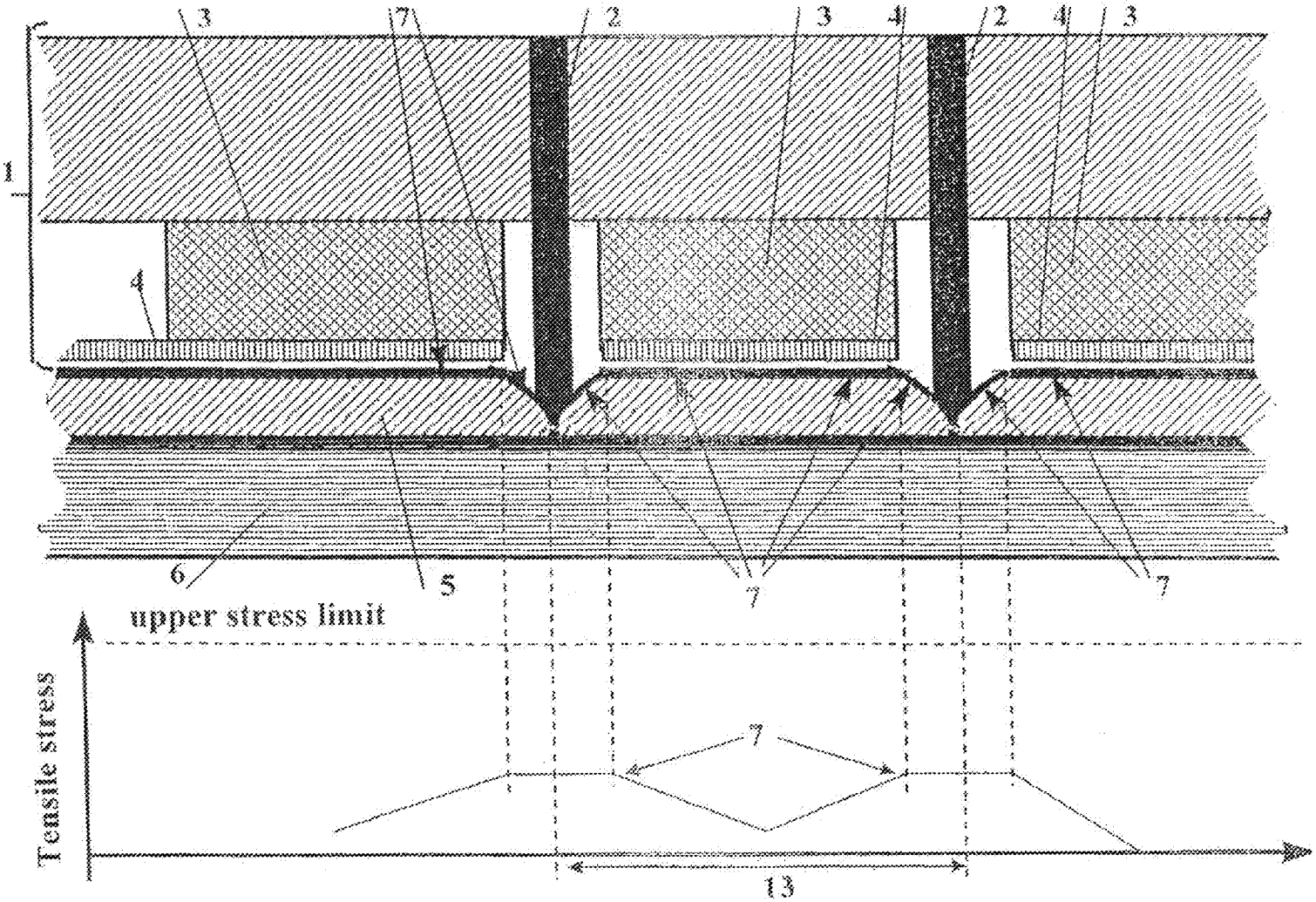
FIG. 3 illustrates the tensile stress concentration at the top surface of the packaging material at die-cutting according to the present invention.

In FIG. 2 the stress concentration is shown for previously known technology where fixed clamping occur between the rubber ejectors and the cutting knife and in FIG. 3 it is shown the stress concentration according to the invention where certain sliding occur between the packaging material and the rubber ejectors dressed with sheet material. Also in a punch form with sheet material according to known art, i.e. not having low friction and/or low adhesion against the packaging material, stress concentration according to FIG. 2 is shown.

In order to reduce the stress concentrations in the surface of the packaging material 5 a sliding movement of the packaging material 5 must be allowed in the direction of the plane in relation to the sheet material 4 in the punch form 1.

A certain friction force and a certain adhesion arise between the packaging material 5 and the sheet material 4 when the punching pressure is activated, whereby tensile stress 7 arises on the surface of the packaging material 5. When the friction force and the adhesion force are overcome a certain sliding is initiated instead that a crack would arise in the surface. The released elastic energy when the sliding is initiated is fully or partly absorbed in the friction surface all the way to the next cutting knife 2 or scoring rule.

Figure 4:
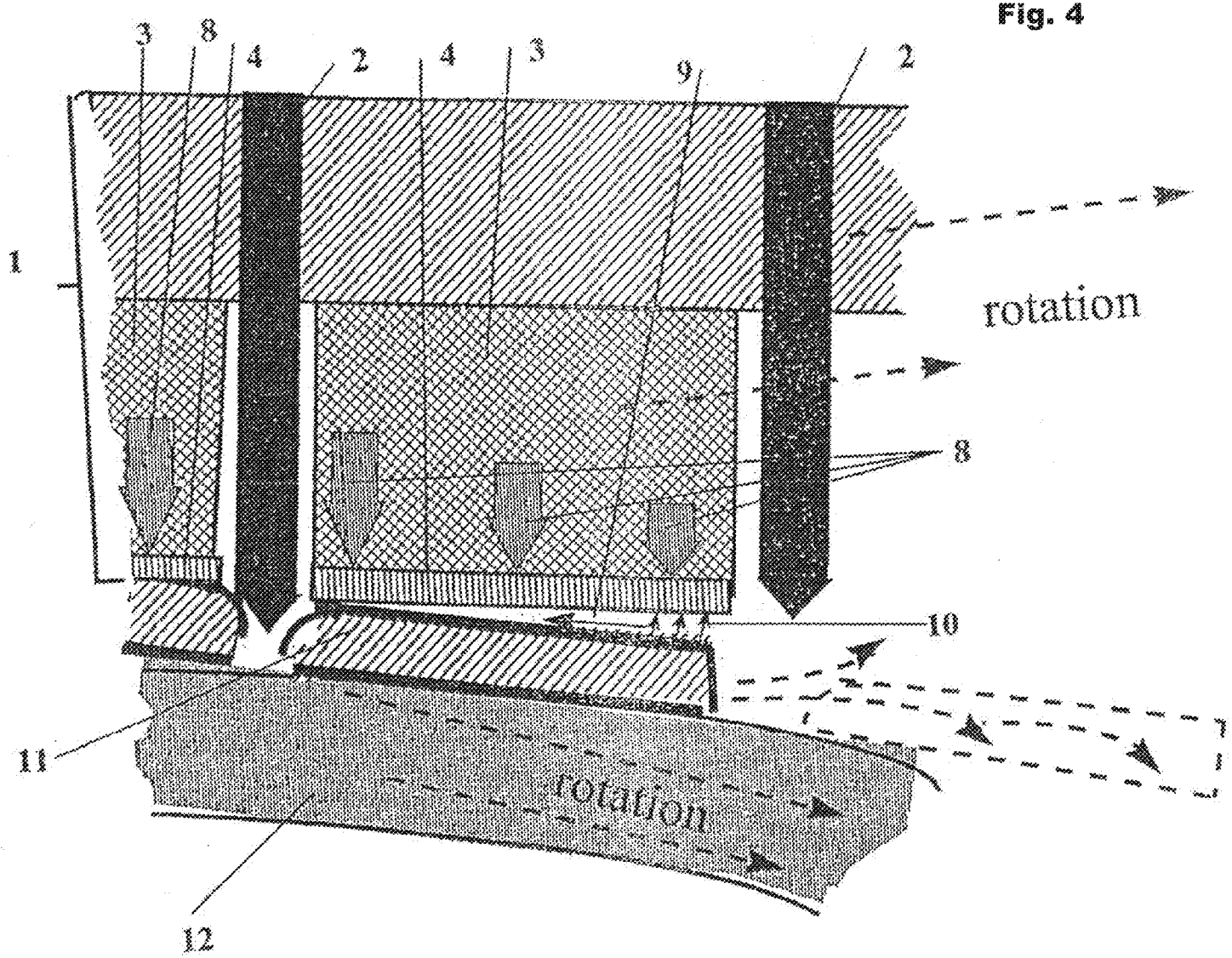
FIG. 4 illustrates the ejection force and the friction and adhesion forces acting on the die-cutting spill in the punching nip when it with high speed is cut off and ejected from the punch form and at the same time with high pressure sheared off by a rotating anvil roller from the sheet material dressed surface of the punch form.

In FIG. 4 it is shown how die-cutting spill 11 is removed in rotational die-cutting. The die-cutting spill 11 is in this case a portion of the edge of the packaging material which is to be cut off to give the packaging blank the right shape. As is evident the sheet material 4 ejects the die-cutting spill 11 by means of the pressure force 8 of the rubber ejector 3 in the direction towards the rotating anvil roller 12, which acts as an anvil. At the same time as the ejection of the die-cutting spill 11 the die-cutting spill 11 are transported out from the punching nip by the rotating anvil roller 12 by means of shearing against the surface of the anvil roller 12.

In known technology not only crack forming disturbances arouse according to the above but also disturbances when the die-cutting spill 11 was separated from the surface of the rotational punch form, in both of the cases as a result of the fact that fixation of the packaging material in all respects was aimed at during the whole die-cutting course. As a result of this fixation to the sheet material so that friction and adhesion forces 9,10 acted between the die-cutting spill 11 and the previously known sheet material 4, the separation was delayed and disturbed and in certain cases the die-cutting spill 11 "got caught" in the rotational punch form 1 and run the risk of going upwards instead of being transported with the anvil roller 12 in a direction downwards, which resulted in a portion of the die-cutting spill 11 during the production came out together with the die-cut packaging blanks, giving much trouble for the users.

In the present invention which allows sliding during the whole die-cutting course, comprising the sheet material 4 with smooth and low surface friction and low adhesion, the die-cutting spill 11 slides already before it is fully cut off and before described ejection and/or cleaning phase start, which leads to that the anvil roller 12 with ease, without delay and disturbances, with high precision, may remove the die-cutting spill, despite application of high pressures and high speeds.

The invention claimed is:

1. A method for die-cutting corrugated paperboard by means of an apparatus having;

cutting knives and/or scoring rules attached to a punch form, an anvil disposed a spaced distance from the punch form and facing the cutting knives and/or scoring rules of the punch form, the anvil having a work supporting surface that extends on both sides of each of the cutting knives and/or scoring rules, at least one ejector attached to the punch form a spaced distance from the cutting knives and/or scoring rules, and a sheet material which is a) arranged on the at least one ejector, and b) extends outside the at least one ejector, and c) is spaced from the cutting knives and/or scoring rules, and d) comes into planar contact with the corrugated paperboard during cutting, and e) is made from a low friction and low adhesion material to enable the corrugated paperboard to slide relative to the sheet material during cutting to reduce cracking of the corrugated paperboard at least in connection with the cutting knives and/or scoring rules, the method comprising:

feeding the corrugated paperboard between the punch form and the anvil;

cutting and/or scoring the corrugated paperboard with the cutting knives and/or scoring rules; and during the cutting and/or scoring step, applying clamping pressure to the sheet material so that the sheet material of the punch form comes into planar contact with the corrugated paperboard such that the corrugated paperboard is not crushed by the at least one ejector;

further during the cutting and/or scoring step, allowing the sliding of a top surface of the corrugated paperboard horizontally relative to the clamping sheet material while the sheet material is in contact with the corrugated paperboard, while an elongation in the top surface of the corrugated paperboard is distributed between the cutting knives and/or scoring rules in order to distribute load energy applied by the cutting knives and/or scoring rules so that the load energy does not reach crack propagating levels in the corrugated paperboard;

releasing the clamping pressure on the sheet material; and using the at least one ejector to remove the corrugated paperboard from between the cutting knives and/or scoring rules, wherein the sliding of the to surface of the corrugated paperboard relative to the sheet material results from a friction and an adhesion between the sheet material and the corrugated paperboard being so low.

2. The method according to claim 1, further comprising continuously supplying a surface of the sheet material with a friction and adhesion reducing agent.

3. The method according to claim 1, further comprising intermittently supplying a surface of the sheet material with a friction and adhesion reducing agent.

4. The method according to claim 1, wherein the sheet material is of a material with low surface friction or at least provided with a surface with low surface friction, where the surface friction does not exceed 0.39.

5. The method according to claim 4, wherein the surface friction does not exceed 0.33.

6. The method according to claim 1, wherein the sheet material is of a material with low adhesion or at least partly provided with a surface with low adhesion, where the adhesion does not exceed 0.050 N/m.

7. The method according to claim 6, wherein the adhesion does not exceed 0.043 N/m.

8. The method according to claim 1, wherein the sheet material is of a hydrophobic material or at least partly provided with a surface of a hydrophobic material.

9. The method according to claim 1, wherein the sheet material includes polytetrafluoroethylene (PTFE) or silicone oil or is at least partly provided with a surface including polytetrafluoroethylene (PTFE) or silicone oil.

* * * * *